US006615816B2

(12) United States Patent
Ogata

(10) Patent No.: US 6,615,816 B2
(45) Date of Patent: Sep. 9, 2003

(54) ROTARY CUTTING SAW HAVING ABRASIVE SEGMENTS IN WHICH WEAR-RESISTANT GRAINS ARE REGULARLY ARRANGED

(75) Inventor: Seiya Ogata, Ukiha-gun (JP)

(73) Assignees: Noritake Co., Limited, Nagoya (JP); Noritake Super Abrasive Co., Ltd., Ukiha (JP)

( * ) Notice: Subject to any disclaimer, the term of this patent is extended or adjusted under 35 U.S.C. 154(b) by 0 days.

(21) Appl. No.: 10/200,231

(22) Filed: Jul. 23, 2002

(65) Prior Publication Data

US 2003/0019489 A1 Jan. 30, 2003

(30) Foreign Application Priority Data

Jul. 26, 2001 (JP) ..... 2001-226549

(51) Int. Cl.[7] ..... B24D 5/06; B24D 5/14
(52) U.S. Cl. ..... 125/15; 451/542
(58) Field of Search ..... 125/15, 13.01; 451/542, 541, 540

(56) References Cited

U.S. PATENT DOCUMENTS 3,338,230 A * 8/1967 Lindblad ..... 451/542
4,665,887 A * 5/1987 Shiga ..... 125/15
5,443,418 A * 8/1995 Frodin et al. ..... 451/540
6,033,295 A * 3/2000 Fisher et al. ..... 451/540
6,408,838 B1 * 6/2002 Ogata et al. ..... 125/15

FOREIGN PATENT DOCUMENTS

| | | | | |
|---|---|---|---|---|
| DE | 2318378 | * | 9/1974 | ..... 125/15 |
| JP | U 47-6491 | | 9/1972 | |
| JP | Y2 53-13991 | | 4/1978 | |
| JP | A 57-83372 | | 5/1982 | |
| JP | Y2 60-12694 | | 4/1985 | |
| JP | B2 7-12592 | | 2/1995 | |

* cited by examiner

*Primary Examiner*—Robert A. Rose
(74) *Attorney, Agent, or Firm*—Oliff & Berridge, PLC.

(57) ABSTRACT

A rotary cutting saw including (a) a base disk and (b) a plurality of abrasive segments fixed to an outer circumferential surface of the base disk and are spaced apart from each other in a circumferential direction of the base disk. The base disk has a plurality of slits which are formed in the outer circumferential surface of the base disk and are located between adjacent ones of the abrasive segments in the circumferential direction. Each slit extends inwardly in a radial direction of the base disk from the outer circumferential surface of the base disk. Each of the abrasive segments includes abrasive grains and wear-resistant grains each of which has a size substantially equal to a size of each of the abrasive grains. The wear-resistant grains are exposed on a side surface of each abrasive segment and are regularly arranged on the side surface.

8 Claims, 3 Drawing Sheets

ROTARY CUTTING SAW HAVING ABRASIVE SEGMENTS IN WHICH WEAR-RESISTANT GRAINS ARE REGULARLY ARRANGED

BACKGROUND OF THE INVENTION

1. Field of the Invention

The present invention relates in general to a rotary cutting saw which is used for cutting, parting or grinding a stone, a concrete, an asphalt, a brick, a ceramic or other hard work material.

2. Discussion of the Related Art

There is known a rotary cutting saw 30, as illustrated in FIG. 3, consisting principally of a base disk 31 and a plurality of abrasive segments 32 which are fixed to an outer circumferential surface of the base disk 31 so as to be circumferentially spaced apart from each other at a constant angular interval therebetween. In portions of the outer circumferential surface of the base disk 31 each of which is located between adjacent ones of the abrasive segments 32, there are formed cutouts or slits 33 each of which extends inwardly in the radial direction of the base disk 31 from the outer circumferential surface of the base disk 31. Each abrasive segment 32, which is referred to also as a segment chip, consists of a small piece including diamond abrasive grains or other abrasive grains which are held together with a metal bond or other bonding agent. This rotary cutting saw 30 is a tool which is generally referred also to as a cutting blade, a rotary blade, a cutting grindstone or a grinding wheel, and which is generally used for cutting or parting a stone, a concrete, an asphalt, a brick, a ceramic or other hard work material.

During a parting or cutting operation with the rotary cutting saw 30, the rotary cutting saw 30 is rotated and is moved relative to a work material in a cutting direction that is perpendicular to an axis of the cutting saw 30. The slits 33 facilitate evacuation of cutting chips (that are produced at the cutting point) from a slot being currently formed in the work material, thereby making it possible to improve the cutting or parting performance of the rotary cutting saw 30. In this instance, a relatively large amount of load is applied to each of axially opposite end portions of the abrasive segment 32 (which portions constitute portions of respective axially opposite end surfaces of the cutting saw 30) in a direction opposite to the cutting direction, while a relatively small amount of load is applied to an axially intermediate portion of the abrasive segment 32 in the direction opposite to the cutting direction. Therefore, each of the axially opposite end portions of the abrasive segment 32 tends to be worn in a larger amount, than the axially intermediate portion of the abrasive segment 32.

In view of such a drawback, there have been proposed various rotary cutting saws or grinding wheels, as disclosed in JP-Y2-S53-13991 (publication of examined Japanese Utility Model Application laid open in 1978), JP-U-S47-6491(publication of unexamined Japanese Utility Model Application laid open in 1972), JP-A-S57-83372 (publication of unexamined Japanese Patent Application laid open in 1982) and JP-Y2-S60-12694 (publication of examined Japanese Utility Model Application laid open in 1985), in the interest of minimizing a local wear of the working or grinding surface of the cutting saw or grinding wheel.

Specifically described, JP-Y2-S53-13991 discloses a grinding wheel which includes an abrasive layer bonded to an outer circumferential surface of a base disk. The abrasive layer of this grinding wheel consists of an intermediate portion and opposite end portions located on respective opposite sides of the intermediate portion as viewed in an axial direction of the grinding wheel, wherein each of the axially opposite end portions has a higher degree of density of abrasive grains than the axially intermediate portion. JP-U-S47-6491 discloses a grinding wheel in which the abrasive layer consists of an axially intermediate portion and axially opposite end portions, wherein each of the axially opposite end portions has a higher degree of bonding strength for bonding the abrasive grains than the axially intermediate portion. JP-A-S57-83372 discloses a rotary cutting saw having a plurality of abrasive segments each consisting of main grinding layers and auxiliary grinding layers which are alternately arranged as viewed in an axial direction, wherein opposite end portions of each abrasive segment are provided by the main grinding layers. Each of the main grinding layers has a higher degree of density of abrasive grains than each of the auxiliary grinding layers. JP-Y2-S60-12694 discloses a rotary cutting saw having a plurality of abrasive segments each consisting of a body portion and cylindrical portions which are embedded in the body portion. Each of the cylindrical portions has a lower degree of density of abrasive grains than the body portion, or alternatively, the abrasive grains or bonding agent of each cylindrical portion has a lower degree of hardness than that of the body portion.

However, in each of the above-described cutting saws or grinding wheels in which the abrasive layer or segment is constituted by a plurality of portions different from each other in characteristics or properties, the abrasive layer or segment in its entirety is easily worn, making it impossible to satisfactorily reduce amount of wear in the axially opposite end portions of the abrasive layer or segment. In view of such a drawback of the conventional cutting saws or grinding wheels, the present applicant invented a rotary cutting saw including a base disk and a plurality of abrasive segments which are fixed to an outer circumferential surface of the base disk, wherein each abrasive segment has a larger thickness than the base disk so that each of opposite end portions of each abrasive segment is projects from the corresponding side surface of the base disk outwardly as viewed in an axial direction of the base disk. Each of the opposite end portions of the abrasive segment includes not only abrasive grains but also wear-resistant grains having substantially the same size of the abrasive grains, such that each of opposite side surfaces of the abrasive segment is provided by a wear-resistant surface on which the wear-resistant grains as well as the abrasive grains dispersively exposed. This rotary cutting saw is disclosed in JP-B2-H7-12592 (publication of examined Japanese Patent Application laid open in 1995). This rotary cutting saw is capable of maintaining a flatness or uniformity of the working surface of each abrasive segment more satisfactorily than the above-described conventional tools, and reducing amount of wear in the axially opposite end portions of each abrasive segment.

However, even this rotary cutting saw disclosed in JP-B2-H7-12592 has a technical problem to be solved. In this rotary cutting saw, a ratio of a sum of cross sectional areas of the wear-resistant grains exposed on the side surface of each abrasive segment with respect to an area of the entirety of the side surface is 3–20%. Since the wear-resistant grains are dispersed or distributed at random on the side surface, a spacing distance between each adjacent pair of the wear-resistant grains is not constant. As a result, a sufficient degree of wear resistance can not be obtained, particularly, in local portions of the side surface in which a density of the wear-resistant grains is relatively low. Further, a recess or groove is likely to be formed in each of such local portions as a result of their wear. The formation of the groove impedes flows of cutting (cooling) fluid or cutting chips, thereby making it difficult to distribute the cutting fluid evenly over the entirety of the side surface of each abrasive segment, and making it difficult to satisfactorily improve the cutting performance and prolong the service life.

SUMMARY OF THE INVENTION

It is therefore an object of the present invention to provide a rotary cutting saw having abrasive segments each of which has, in its opposite side surfaces, wear-resistant surfaces in which wear-resistant grains are distributed in an improved manner, for thereby effectively reducing amount of wear of each wear-resistant side surface while maintaining an excellent cutting performance. This object may be achieved according to any one of first through ninth aspects of the invention which are described below.

The first aspect of this invention provides a rotary cutting saw comprising: (a) a base disk; and (b) a plurality of abrasive segments which are fixed to an outer circumferential surface of the base disk and are spaced apart from each other in a circumferential direction of the base disk, each of the abrasive segments having a side surface which constitutes a portion of an axial end surface of the rotary cutting saw; wherein the base disk has a plurality of slits which are formed in the outer circumferential surface of the base disk and are located between adjacent ones of the abrasive segments in the circumferential direction, each of the plurality of slits extending inwardly in a radial direction of the base disk from the outer circumferential surface of the base disk, wherein each of the abrasive segments includes abrasive grains and wear-resistant grains each of which has a size substantially equal to a size of each of the abrasive grains, and wherein the wear-resistant grains are exposed on the side surface and are regularly arranged on the side surface.

In the rotary cutting saw defined in this first aspect of the invention in which the wear-resistant grains are arranged in a predetermined pattern on the side surface of each abrasive segment, it is possible to arrange the wear-resistant grains such that the wear-resistant grains are equally spaced apart from each other, or such that a distribution density of the wear-resistant grains is constant over the entirety of the side surface of each abrasive segment, thereby permitting the entirety of the side surface to be evenly worn. The even wear in the entirety of the side surface facilitates flows of the cutting fluid or cutting chips, improving the cutting performance and accordingly prolonging the service life of the rotary cutting saw.

According to the second aspect of the invention, in the rotary cutting saw defined in the first aspect of the invention, a ratio of a sum of cross sectional areas of the wear-resistant grains exposed on the side surface of each of the abrasive segments, to an area of the side surface is 2–20%.

According to the third aspect of the invention, in the rotary cutting saw defined in the second aspect of the invention, the abrasive grains are exposed on said side surface of each of said abrasive segments, and wherein a ratio of a sum of cross sectional areas of said abrasive grains exposed on said side surface, to the area of the side surface is 2–20%.

In the rotary cutting saw defined in the second or third aspect of the invention, the wear-resistant grains are distributed over the side surface of each abrasive segment such that the ratio of the sum of cross sectional areas of the wear-resistant grains to the area of the side surface is 2–20%. The cross sectional area of each wear-resistant grain may be interpreted to mean a maximum cross sectional area or projected area of each wear-resistant grain, wherein the maximum cross sectional area or projected area may be calculated on the basis of an average size of the wear-resistant grains. For example, the ratio of the sum of cross sectional areas of the wear-resistant grains to the area of the side surface may be calculated in accordance with the following equation:

$$\text{Ratio}=\{(A1+A2+A3+\ldots+An)/S\}\times 100(\%)$$

where An represents the projected area of each wear-resistant grain;

n represents a number of wear-resistant grains exposed on the side surface; and

S represents the area of the side surface.

The ratio serves as an index representative of a degree of wear resistance of the side surface, so that the degree of wear resistance is generally increased with an increase of the ratio (hereinafter referred to as "wear-resistant-grains distribution ratio").

If the wear-resistant-grains distribution ratio is lower than 2%, this ratio would be substantially equal to or lower than the ratio of the sum of cross sectional areas of the abrasive grains to the area of the side surface of each abrasive segment, thereby making it difficult to permit the entirety of the side surface to be evenly worn. If the wear-resistant-grains distribution ratio is higher than 20%, the wear-resistant grains would be excessively exposed on an upper surface of each abrasive segment which constitutes a portion of an outer circumferential surface of the rotary cutting saw. If the wear-resistance grains are excessively exposed on the outer circumferential surface of the rotary cutting saw which serves as a grinding or cutting surface during a cutting operation of the cutting saw, the cutting operation has to be carried out with an increased cutting resistance and accordingly a reduced efficiency of the cutting operation.

According to the fourth aspect of the invention, in the rotary cutting saw defined in the first aspect of the invention, the wear-resistant grains have a higher degree of toughness index than that of the abrasive grains.

The wear-resistant grains may be provided by diamond grains, CBN (cubic boron nitrides) grains, diamond or CBN grains each coated with a metal coating, $W_2C$ grains, $Al_2O_3$ grains or TiC grains. The term "toughness index (TI)" is an index representative of a degree of breaking or fracture strength, so that the grains are more likely to be fractured or worn where the grains have a relatively low degree of toughness index, than where the grains have a relatively high degree of toughness index. The wear-resistant grains does not have to be necessarily have a higher degree of "toughness index" than that of the abrasive grains, but may have a lower degree of "toughness index" than that of the abrasive grains.

The "toughness index" may be calculated, for example, in the following manner:

(1) Putting a predetermined amount (e.g., 2.00 g) of grains, together with steel balls (e.g., three balls each having a diameter of 3 mm), into a vessel;

(2) Vibrating the vessel during a predetermined time (e.g., two minutes);

(3) Sieving the grains by using a sieve (e.g., sieve of #50 where the grains have a grain size of #40); and (4) Measuring an amount of the grains remaining on the sieve.

The toughness index can be expressed by a ratio of the amount of the remaining grains to the above-described predetermined amount of the grains. If the predetermined amount of the grains and the measured amount of the remaining grains are 2.00 g and 1.70 g, respectively, the toughness index would be 85%.

According to the fifth aspect of the invention, in the rotary cutting saw defined in the first aspect of the invention, a ratio of an average size of the wear-resistant grains to an average size of the abrasive grains is 0.7–1.0. This ratio is more preferably 0.75–0.90.

If the above-described ratio is smaller than 0.7, the wear-resistant grains are likely to be removed from each abrasive segment when the side surface of each abrasive segment is subjected to a dressing operation. If the above-described ratio is larger than 1.0, each wear-resistant grain is likely to protrude in a larger amount than each abrasive grain, thereby deteriorating a cutting performance of the rotary cutting saw. Each wear-resistant grain is embedded in the abrasive segment with a depth smaller than the grain size so that each wear-resistant grain is exposed on the side surface of the abrasive segment. If each wear-resistant grain is embedded excessively deeply in the abrasive segment, the excessively embedded wear-resistant grain undesirably serves as a resistance against a cutting action of each abrasive grain.

According to the sixth aspect of the invention, in the rotary cutting saw defined in the first aspect of the invention, the wear-resistant grains are arranged in a lattice.

According to the seventh aspect of the invention, in the rotary cutting saw defined in the first aspect of the invention, the wear-resistant grains are equally spaced apart from each other by a predetermined first distance as viewed in a rotary direction of the rotary cutting saw, and where the wear-resistance grains are equally spaced apart from each other by a predetermined second distance as viewed in a radial direction of the rotary cutting saw.

The arrangement of the wear-resistant grains is not limited to a particular pattern. However, the wear-resistant grains are arranged preferably in a staggered manner or a lattice manner, as in the rotary cutting saw constructed according to the sixth aspect of the invention. Further, it is preferable that the wear-resistant grains are equally spaced from each other by the predetermined first distance as viewed in the rotary direction of the rotary cutting saw and by the predetermined second distance as viewed in the radial direction of the rotary cutting saw. The wear-resistant grains may be spaced from each other such that the predetermined first distance is larger than the predetermined second distance. Further, it is also possible to limit a portion of the side surface of each abrasive segment in which portion the wear-resistant grains are provided, thereby making it possible to establish high resistance portions and low resistance portions on the side surface of each abrasive segment. The low resistant portion may be provided by, for example, a portion in which the wear-resistant grains are not provided. The low resistant portion is likely to be worn in an earlier stage than the high resistant portion, whereby a groove is possibly formed as a result of the wear of the low resistant portion. The thus formed groove serves as a passage though which a cutting (cooling) fluid flows during the cutting operation.

According to the eighth aspect of the invention, in the rotary cutting saw defined in the seventh aspect of the invention, each of the predetermined first and second distances is not smaller than twice the size of each of the wear-resistant grains, and is not larger than five times the size of each of the wear-resistant grains.

An experiment conducted by the present inventor revealed that each wear-resistant grain prevented wear of a portion of the side surface of each abrasive segment which portion is located on a rear side of the wear-resistant grain as viewed in the rotary direction and which portion has a length about ten times as large as the size of the wear-resistance grain. However, while a front part of this portion (which part is contiguous to the wear-resistant grain and has a length about five times as large as the size of the wear-resist grain) was satisfactorily prevented from being worn, a rear part of this portion (which part is located on a rear side of the front part) was not satisfactorily prevented from being worn. That is, the rear part of the portion was not sufficiently protected by the wear-resistant grain, and was accordingly somewhat worn. In view of this experiment, the first distance (by which the wear-resistant grains are spaced apart from each other as viewed in the rotary direction of the rotary cutting saw) is preferably not larger than five times the average size of the wear-resistant grains. The second distance (by which the wear-resistant grains are spaced apart from each other as viewed in the radial direction of the rotary cutting saw) is preferably minimized as much as possible. However, if the spacing distance between each adjacent pair of the wear-resistant grains is smaller than twice the average size of the wear-resistant grains, an operation for arranging the wear-resistant grains would be extremely difficult. In this aspect, each of the predetermined first and second distances is not smaller than twice the average size of the wear-resistant grains.

The spacing distance between each adjacent pair of the wear-resistant grains may be suitably determined depending upon a kind of work material and a cutting condition, such that the side surface of each abrasive segment is evenly worn. The increased degree of wear resistance of the side surface of each abrasive segment is effective to prevent the upper surface of each abrasive segment (which constitutes a portion of the outer circumferential surface of the rotary cutting saw) from being worn to have a convexed cross sectional shape, and also to permit the rotary cutting saw to perform a cutting operation with a reduced cutting resistance and an improved cutting efficiency.

According to the ninth aspect of the invention, in the rotary cutting saw defined in any one of the first through eighth aspects of the invention, each of the abrasive segments has an upper surface which constitutes a portion of an outer circumferential surface of the rotary cutting saw, wherein each of the abrasive segments has a recess or groove formed in the upper surface.

In general, the outer circumferential surface of the rotary cutting saw, which is defined by the upper surfaces of the respective abrasive segments, does not necessarily have a high degree of roundness. However, ones of the plurality of abrasive segments, which protrude radially outwardly further than the other abrasive segments, tend to wear in a larger amount than the other abrasive segments as a result of actual use for a cutting operation, so that the degree of roundness of the outer circumferential surface of the cutting saw is improved. The recess or groove defined in the ninth aspect of the invention is effective to facilitate such a wear of each abrasive segment during the cutting operation, for improving the degree of roundness of the outer circumferential surface of the cutting saw. In this sense, the groove may be referred to as a roundness improving groove.

Each abrasive segment of the rotary cutting saw of the invention may be manufactured, for example, in any one of various processes. One of the processes includes a step of bonding the wear-resistant grains to dies which serve to form the respective opposite side surfaces of the abrasive segment, a step of filling a space defined between the dies, with the abrasive grains and bonding agent, and a step of sintering the abrasive grains and the bonding agent. Another one of the processes includes a step of charging a die with the wear-resistant grains so as to form a layer including the wear-resistant grains, a step of charging the die with the abrasive grains and the boding agent so as to from a layer including the abrasive grains and the bonding agent, on the layer of the wear-resistant grains, a step of charging the die with the wear-resistant grains so as to form a layer including the wear-resistant grains, on the layer of the abrasive grains and the bonding agent, and a step of sintering the three layers simultaneously with each other. Still another one of the process includes a step of forming a green body including the abrasive grains, a step of boding the wear-resistant grains onto opposite side surfaces of the green body with an adhesive, and a step of sintering the green body.

BRIEF DESCRIPTION OF THE DRAWINGS

The above and other objects, features, advantages and technical and industrial significance of this invention will be better understood by reading the following detailed description of the presently preferred embodiment of the invention, when considered in connection with the accompanying drawings, in which.

DETAILED DESCRIPTION OF THE PREFERRED EMBODIMENT

Figure 1:
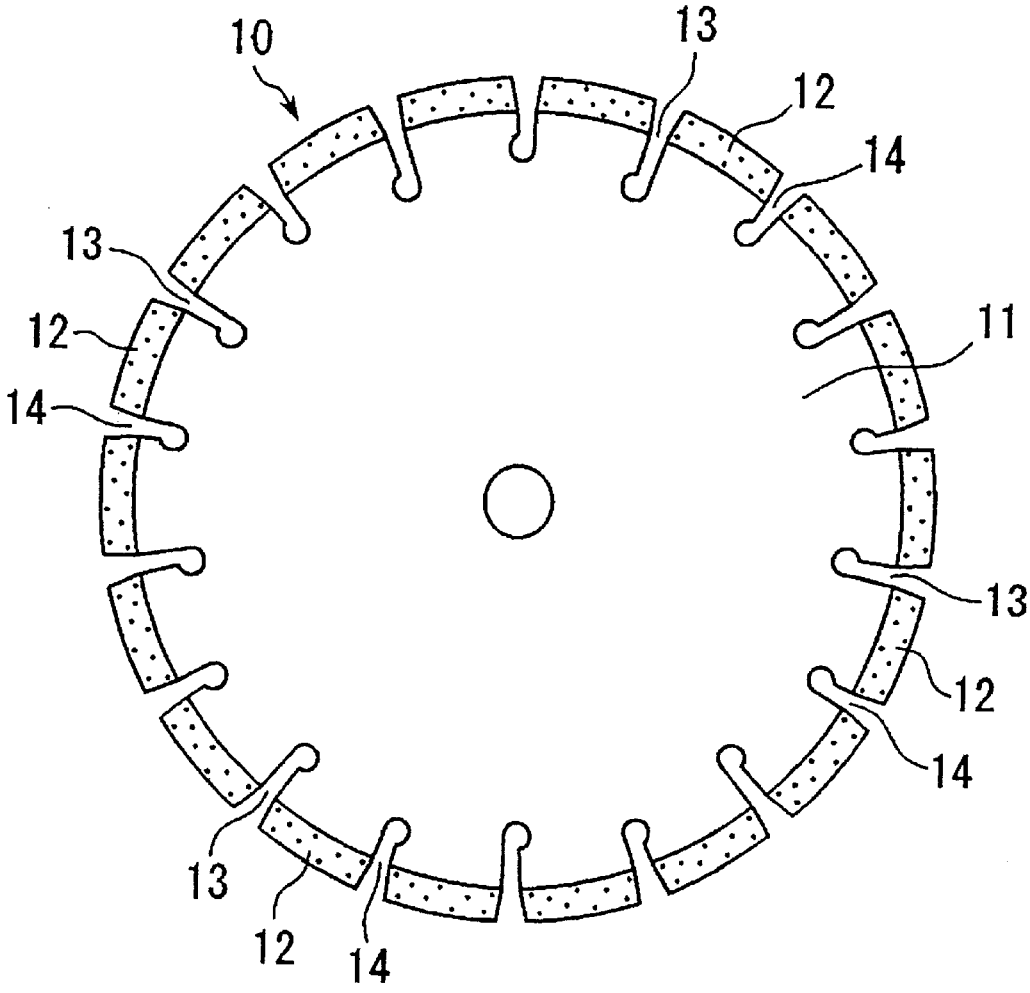
FIG. 1 is a plan view showing a rotary cutting saw constructed according to one embodiment of this invention.
Figure 2:
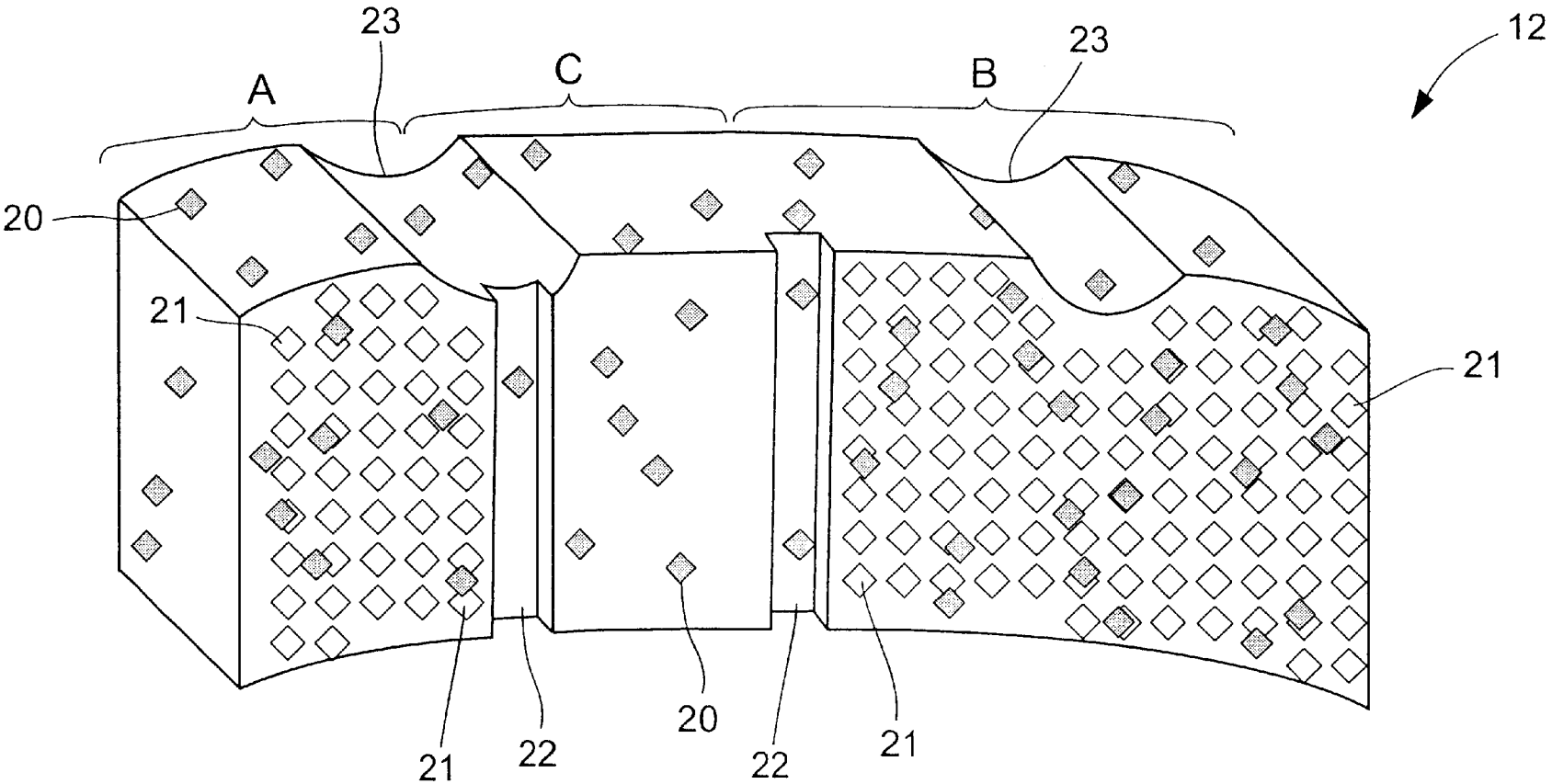
FIG. 2 is an enlarged view showing one of a plurality of abrasive segments of the rotary cutting saw of FIG. 1.
Figure 3:
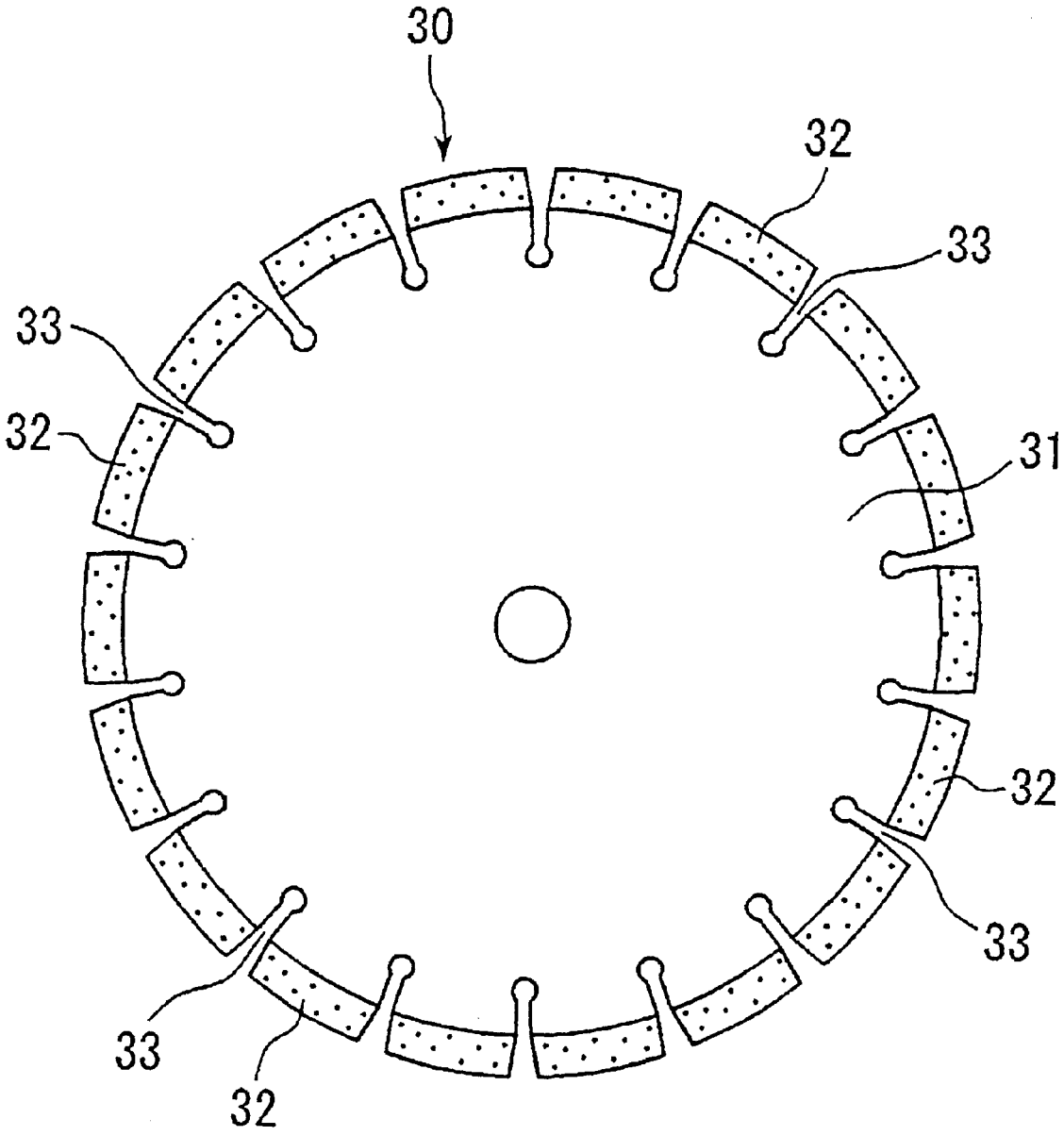
FIG. 3 PRIOR ART
FIG. 3 is a plan view showing a conventional rotary cutting saw.

Referring to FIGS. 1 and 2, there will be described a rotary cutting saw 10 which is constructed according to an embodiment of the invention. This rotary cutting saw 10 includes a base disk 11 made of a carbon tool steel, and a plurality of diamond abrasive segments 12 bonded to an outer circumferential surface of the base disk 11 such that the abrasive segments 12 are equally spaced apart from each other in a circumferential direction of the base disk 11. The base disk 11 has a plurality of first slits 13 and a plurality of second slits 14 which extend inwardly in a radial direction of the base disk 11 from the outer circumferential surface and also in an axial direction oft the base disk 11 over an entire thickness or axial length of the base disk 11. The first slits 13 and the second slits 14, each of which is different in shape from each first slit 13, are alternately arranged in the circumferential direction. The rotary cutting saw 10 has an outside diameter of about 379 mm, while each of the abrasive segments 12 has a length of about 47 mm as measured in the circumferential direction of the base disk 11, a thickness of about 3.3 mm as measured in the axial direction of the base disk 11, and a height of about 12 mm as measured in the radial direction of the base disk 11.

FIG. 2 is a view schematically showing the arrangement of wear-resistant grains on one of opposite side surfaces of each abrasive segment 12, which surface constitutes a portion of an axial end surface of the rotary cutting saw 10. Each abrasive segment 12 includes sections A, B which are provide by respective lengthwise opposite end portions of the abrasive segment 12, and a section C which is provided by an lengthwise intermediate portion of the abrasive segment 12, as shown in FIG. 2. The wear-resistant grains in the from of second diamond abrasive grains 21, as well as the abrasive grains in the form of first diamond abrasive grains 20, are disposed on the side surface in the sections A, B of the abrasive segment 12. The second diamond grains 21 as the wear-resistant grains serve to increase a wear resistance of the side surface of the abrasive segment 12. In the present embodiment, the second diamond grains 21 are arranged in a lattice.

The first diamond abrasive grains 20 as the abrasive grains have a grain size of F30 (#30), while the second diamond abrasive grains 21 as the wear-resistant grains have a grain size do F40 (#40). In the section of C of the abrasive segment 12 in which the second diamond abrasive grains 21 are not provided, there are formed radially-extending grooves 22 which facilitate evacuation of cutting chips produced during a cutting operation of the cutting saw 10. The grooves 22 are formed on the side surface of the abrasive segment 12, and extend in the height direction of the abrasive segment 12, i.e., in the radial direction of the base disk 11, over the entire height of the abrasive segment 12, as shown in FIG. 2. The abrasive segment 12 further has axially-extending grooves 23 formed in its upper surface which constitutes a portion of an outer circumferential surface of the rotary cutting saw 10, and extending in the thickness direction of the abrasive segment 12, i.e., in the axial direction of the base disk 11, over the entire thickness of the abrasive segment 12, as shown in FIG. 2. Owing to the provision of the grooves 23 in the upper surface of the abrasive segment 12, the area of the upper surface is reduced for thereby facilitating a wear of the abrasive segment 12 for improving a degree of roundness of the outer circumferential surface of the rotary cutting saw 10. In this sense, the grooves 23 may be referred to as a roundness improving grooves.

A portion of the side surface which portion is included in the section A has a first predetermined area, while a portion of the side surface which portion is included in the section B has a second predetermined area, such that a sum of the first and second predetermined areas corresponds to about 72% of the total area of the side surface. The second diamond abrasive grains 21, arranged in a lattice, are spaced apart from each other by a spacing distance of about 1.25 mm which is about three times as large as the average grain size of the second diamond abrasive grains 21, so that the second diamond abrasive grains 21 as the wear-resistant grains are distributed over the side surface of the abrasive segment 12, with a ratio of sum of cross section areas of the second diamond abrasive grains 21 to the total area of the side surface being of 5.8%. It is noted that this ratio will be referred to as "wear-resistant-grains distribution ratio" in the following description.

The second diamond abrasive grains 21 may be arranged with a higher degree of density, for example, such that the spacing distance is about twice as large as the average grain size of the second diamond abrasive grains 21. In this case, the above-described wear-resistant-grains distribution ratio is about 20%. Further, the second diamond abrasive grains 21 may be arranged with a lower degree of density, for example, such that the spacing distance is about five times as large as the average grain size of the second diamond abrasive grains 21. In this case, the above-described wear-resistant-grains distribution ratio is about 3%.

There will be described an actual cutting test which was conducted to confirm the advantage provided by the present invention, namely, by the arrangement of the wear-resistant grains according to the present invention. In the test, there were used ten rotary cutting saws each having a basic configuration substantially identical to that of the rotary cutting saw of FIG. 1. The ten rotary cutting saws consisted of Examples 1–5 in each of which the wear-resistant grains are arranged in the abrasive segments as shown in FIG. 2, and Comparative Examples 6–10 in each of which the wear-resistant grains are not provided in the abrasive segments. Table 1 indicates a cutting condition in which the cutting test was carried out. Table 2 indicates the dimensions of each rotary cutting saw and the result of the cutting test as to each rotary cutting saw.

TABLE 1

| | |
|---|---|
| Cutting Machine | Car-type Engine Cutter<br>Drive motor: 37 kW (50HP) |
| Number of Revolutions of Spindle (on which the saw is mounted) | 2400 rpm |
| Depth of Cut | 100 mm |
| Work Material | Asphalt Road Surface<br>Thickness 150 mm |

TABLE 2

| | Average Cutting Speed (m/min) | Duration (m) | Convex-shaped Wear (mm) | Remained Thickness (mm) |
|---|---|---|---|---|
| Example 1 | 4.5 | 4850 | 0.8 | 2.9 |
| Example 2 | 4.2 | 4080 | 0.9 | 2.8 |
| Example 3 | 4.0 | 4620 | 0.8 | 2.9 |
| Example 4 | 4.7 | 5040 | 0.7 | 2.8 |
| Example 5 | 4.6 | 5690 | 0.7 | 2.8 |
| Average values of Examples 1–5 | 4.4 | 4856 | 0.78 | 2.84 |
| Comparative Example 6 | 3.4 | 2980 | 1.7 | 2.4 |
| Comparative Example 7 | 4.0 | 2850 | 2.1 | 2.5 |
| Comparative Example 8 | 3.9 | 3280 | 1.8 | 2.5 |
| Comparative Example 9 | 3.8 | 2660 | 1.8 | 2.6 |
| Comparative Example 10 | 3.9 | 3330 | 2.0 | 2.4 |
| Average values of Comparative Examples 6–10 | 3.8 | 3020 | 1.88 | 2.48 |

In Table 2, the "Average Cutting Speed" represents a measured length of the slot which was formed per minute. In the test, the cutting machine (which carries the rotary cutting saw) was adjusted to change the cutting speed in such a manner that permits an actual number of revolutions of a drive motor being held larger than 90% of a predetermined number of revolutions. Namely, the cutting speed was reduced as needed such that the actual number of revolutions was not reduced by an amount larger than 10% of the predetermined number of revolutions. That is, the cutting speed was reduced with an increase in cutting resistance acting on the rotary cutting saw. Accordingly, a large value of the cutting speed represents a high degree of cutting performance. The "Duration" represents a measured length of the slot which was formed until the amount of wear of the abrasive segment as measured in the radial direction was increased to a predetermined amount. The "Convex-shaped Wear" represents an amount of convex-shaped wear of the abrasive segment. The "Remained Thickness" represents a thickness of the abrasive segment which was measured after the cutting operation.

As is apparent from Table 2, each of the cutting saws of Examples 1–5, in which the wear-resistant grains are arranged in the abrasive segments as shown in FIG. 2, had a larger thickness ("Remained Thickness") than each of the cutting saws of Comparative Examples 6–10. This means that each of the cutting saws of Examples 1–5 exhibited a smaller amount of wear in the side surfaces of each abrasive segment, than each of the cutting saws of Comparative Examples 6–10. Further, each of the cutting saws of Examples 1–5 had a smaller amount of convex-shaped wear than each of the cutting saws of Comparative Examples 6–10. It is further appreciated from Table 2 that the cutting speed of each of the cutting saws of Examples 1–5 was about 1.15 times as high as that of each of the cutting saws of Comparative Examples 6–10, and that the duration of each of the cutting saws of Examples 1–5 was about 1.60 times as long as that of each of the cutting saws of Comparative Examples 6–10.

It is to be understood that the invention is not limited to the details of the illustrated embodiment, but may be embodied with various other changes, modifications and improvements, which may occur to those skilled in the art, without departing from the spirit and scope of the invention defined in the following claims.

What is claimed is:

1. A rotary cutting saw, comprising:

a base disk; and a plurality of abrasive segments which are fixed to an outer circumferential surface of said base disk and are spaced apart from each other in a circumferential direction of said base disk, each of said abrasive segments having a side surface which constitutes a portion of an axial end surface of said rotary cutting saw;

wherein said base disk has a plurality of slits which are formed in said outer circumferential surface of said base disk and are located between adjacent ones of said abrasive segments in said circumferential direction, each of said plurality of slits extending inwardly in a radial direction of said base disk from said outer circumferential surface of said base disk, wherein each of said abrasive segments includes abrasive grains and wear-resistant grains each of which has a size substantially equal to a size of each of said abrasive grains, wherein said wear-resistant grains are exposed on said side surface and are regularly arranged on said side surface; and wherein said wear-resistant grains are equally spaced apart from each other by a predetermined first distance as viewed in a rotary direction of said rotary cutting saw, and where said wear-resistance grains are equally spaced apart from each other by a predetermined second distance as viewed in a radial direction of said rotary cutting saw.

2. A rotary cutting saw according to claim 1, wherein a ratio of a sum of cross sectional areas of said wear-resistant grains exposed on said side surface of each of said abrasive segments, to an area of said side surface is 2–20%.

3. A rotary cutting saw according to claim 2, wherein said abrasive grains are exposed on said side surface of each of said abrasive segments, and wherein a ratio of a sum of cross sectional areas of said abrasive grains exposed on said side surface, to the area of said side surface is 2–20%.

4. A rotary cutting saw according to claim 1, wherein said wear-resistant grains have a higher degree of toughness index than that of said abrasive grains.

5. A rotary cutting saw according to claim 1, wherein a ratio of an average size of said wear-resistant grains to an average size of said abrasive grains is 0.7–1.0.

6. A rotary cutting saw according to claim 1, wherein said wear-resistant grains are arranged in a lattice.

7. A rotary cutting saw according to claim 1, wherein each of said predetermined first and second distances is not smaller than twice said size of each of said wear-resistant grains, and is not larger than five times said size of each of said wear-resistant grains.

8. A rotary cutting saw according to claim 1, wherein each of said abrasive segments has an upper surface which constitutes a portion of an outer circumferential surface of said rotary cutting saw, and wherein each of said abrasive segments has a groove formed in said upper surface.

* * * * *